US010508885B1

(12) United States Patent
Kauffman, Jr.

(10) Patent No.: US 10,508,885 B1
(45) Date of Patent: Dec. 17, 2019

(54) KNIFE MOUNTS FOR RELEASABLY SECURING A KNIFE TO A FIREARM

(71) Applicant: Adrian Kauffman, Jr., Aurora, OR (US)

(72) Inventor: Adrian Kauffman, Jr., Aurora, OR (US)

( * ) Notice: Subject to any disclaimer, the term of this patent is extended or adjusted under 35 U.S.C. 154(b) by 0 days.

(21) Appl. No.: 16/256,480

(22) Filed: Jan. 24, 2019

(51) Int. Cl.
*F41C 27/18* (2006.01)
*F41C 23/16* (2006.01)
*F41C 23/22* (2006.01)

(52) U.S. Cl.
CPC ..... *F41C 27/18* (2013.01); *F41C 23/16* (2013.01); *F41C 23/22* (2013.01)

(58) Field of Classification Search
CPC ..... F41C 23/16
USPC ..... 89/1.42
See application file for complete search history.

(56) References Cited

U.S. PATENT DOCUMENTS 546,344 A * 9/1895 Prasse ..... F41C 23/16 42/71.01
1,237,330 A * 8/1917 Hammond ..... A01G 3/08 30/296.1
1,511,916 A * 10/1924 Sipes ..... F41C 27/16 42/53
6,968,642 B1 * 11/2005 Leung ..... F41C 23/16 30/162
9,618,299 B1 * 4/2017 Gingrich ..... F41C 27/18
2009/0007478 A1 * 1/2009 Fluhr ..... F41A 5/26 42/90
2011/0173862 A1 * 7/2011 Williams ..... F41C 23/12 42/72
2011/0214329 A1 * 9/2011 Green ..... F41C 27/00 42/90
2014/0215884 A1 * 8/2014 Adcock, Jr. ..... F41B 13/00 42/72
2014/0230303 A1 * 8/2014 Rice ..... F41C 27/16 42/90
2016/0327372 A1 * 11/2016 Schrock ..... F41G 11/003

* cited by examiner

*Primary Examiner* — Derrick R Morgan
(74) *Attorney, Agent, or Firm* — Mohr Intellectual Property Law Solutions, PC

(57) ABSTRACT

Knife mounts configured to selectively secure to a firearm, the knife mount including a body secured between a muzzle and a pistol grip of the firearm, a slot defined in the body and complimentarily configured with the knife to receive the knife, a locking mechanism moveably mounted to the body proximate the slot, the locking mechanism configured to selectively secure the knife within the slot by engaging the handle of the knife, wherein the knife mount rigidly secures the knife in an orientation where the handle of the knife defines a foregrip of the firearm for a user to grip and manipulate the firearm and allows the user to rapidly remove the knife from the body.

20 Claims, 10 Drawing Sheets

KNIFE MOUNTS FOR RELEASABLY SECURING A KNIFE TO A FIREARM

BACKGROUND

The present disclosure relates generally to knife holders. In particular, knife holders in the form of knife mounts for releasably securing a knife to a firearm are described.

Knives have a broad range of uses for a wide variety of people, including soldiers, policemen, hunters, and the self-defense minded. Often, someone utilizing a knife will also have occasion to utilize a firearm and will need to carry both. For example, soldiers often carry a knife and a firearm while on patrol or other mission, a hunter will typically carry both a firearm and a knife into the field while hunting, and a person in a self-defense situation will generally prefer to have a firearm and a knife available to utilize as warranted by the circumstances.

A knife may serve as both weapon and tool and may come in many different shapes, sizes, and configurations. Popular knives include folding knives, out-the-front (OTF) knives, and fixed blade knives. For knives with moveable blades, some knives include features to mechanically assist moving the blade while other knives are designed for the user move the blade manually without mechanical assistance.

A knife mount is a form of knife holder that serves to hold a knife when the knife is not in use. Conventional knife holders generally take the form of sheaths, holsters, scabbards, and bayonet mounts. However, known knife holders are not entirely satisfactory for the range of applications in which they are employed.

For example, existing knife holders must be carried by hand, secured to a user's person, such as to a user's belt or tactical vest, stowed in a pocket or bag, or fixed to the front of a firearm to serve as a bayonet. Disadvantages of known knife holders include limiting a user's mobility, being awkward or fatiguing, being uncomfortable, and being prone to being misplaced. Perhaps most importantly, conventional knife holders can make the time necessary to access the knife for self-defense purposes dangerously and unacceptably long.

Carrying a knife holder occupies a user's hand and limits his ability to perform other tasks. Setting down a knife holder to free up a user's hand creates an opportunity to misplace or forget to retrieve the knife holder. Quite simply, needing to carry a knife holder by hand is inconvenient.

Securing a knife holder to a user's person, such as to a user's ankle, arm, belt, tactical vest, or helmet may be better than carrying it by hand, but is less than ideal in many contexts. For example, a knife holder secured to a user's person can be awkward, uncomfortable, and fatiguing and can limit the user's mobility. In situations where the knife is needed for self-defense, knife holders secured to user's person can increase the time necessary to access the knife and put the person in danger of bodily harm or death.

A knife secured to the front of a firearm as a bayonet presents its own challenges and limitations. For example, a knife mounted to extend beyond the muzzle as a bayonet increases the length of the firearm, which can make the firearm awkward to move in tight quarters. Further, a knife blade extending beyond the front of a gun creates a risk of injury to the user and those around her. A knife mounted as a bayonet also does not provide any benefits for holding or manipulating the firearm. Of significant concern, accessing a knife mounted as a bayonet to use independent of the firearm is unacceptably and dangerously slow.

Thus, there exists a need for knife holders that improve upon and advance the design of known holders. Examples of new and useful knife mounts relevant to the needs existing in the field are discussed below.

SUMMARY

The present disclosure is directed to knife mounts configured to selectively secure to a firearm, the knife mount including a body secured between a muzzle and a pistol grip of the firearm, a slot defined in the body and complimentarily configured with the knife to receive the knife, a locking mechanism moveably mounted to the body proximate the slot, the locking mechanism configured to selectively secure the knife within the slot by engaging the handle of the knife, wherein the knife mount rigidly secures the knife in an orientation where the handle of the knife defines a foregrip of the firearm for a user to grip and manipulate the firearm and allows the user to rapidly remove the knife from the body.

DETAILED DESCRIPTION

The disclosed knife mounts will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various knife mounts are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-10, a first example of a knife mount, knife mount 100, will now be described. Knife mount 100 functions to selectively secure and release a knife 106 to a firearm 104. The reader will appreciate from the figures and description below that knife mount 100 addresses shortcomings of conventional knife mounts.

For example, knife mount 100 allows a user to carry knife 106 without occupying his or her hands holding knife 106, without requiring knife 106 be secured to the user's person, and without needing to fix knife 106 to the front of firearm 104 as a bayonet. By providing a convenient and ergonomic means to carry knife 106, knife mount 100 avoids limiting the user's mobility, reduces fatigue associated with carrying knife 106, avoids discomfort, and helps the user avoid misplacing knife 106.

Knife mount 100 overcomes important limitations associated with a knife mounted to a firearm as a bayonet. Indeed, knife mount 100 allows a user to mount knife 106 to firearm 104 in a position without increasing the length of firearm 104, which aids mobility and maneuverability. By mounting knife 106 to firearm 104 in a position without a blade 110 of knife 106 extending out in front of firearm 104, knife mount 100 helps avoid accidently stabbing, cutting, or otherwise injuring persons near the user carrying knife 106 or the user himself.

Figure 2:
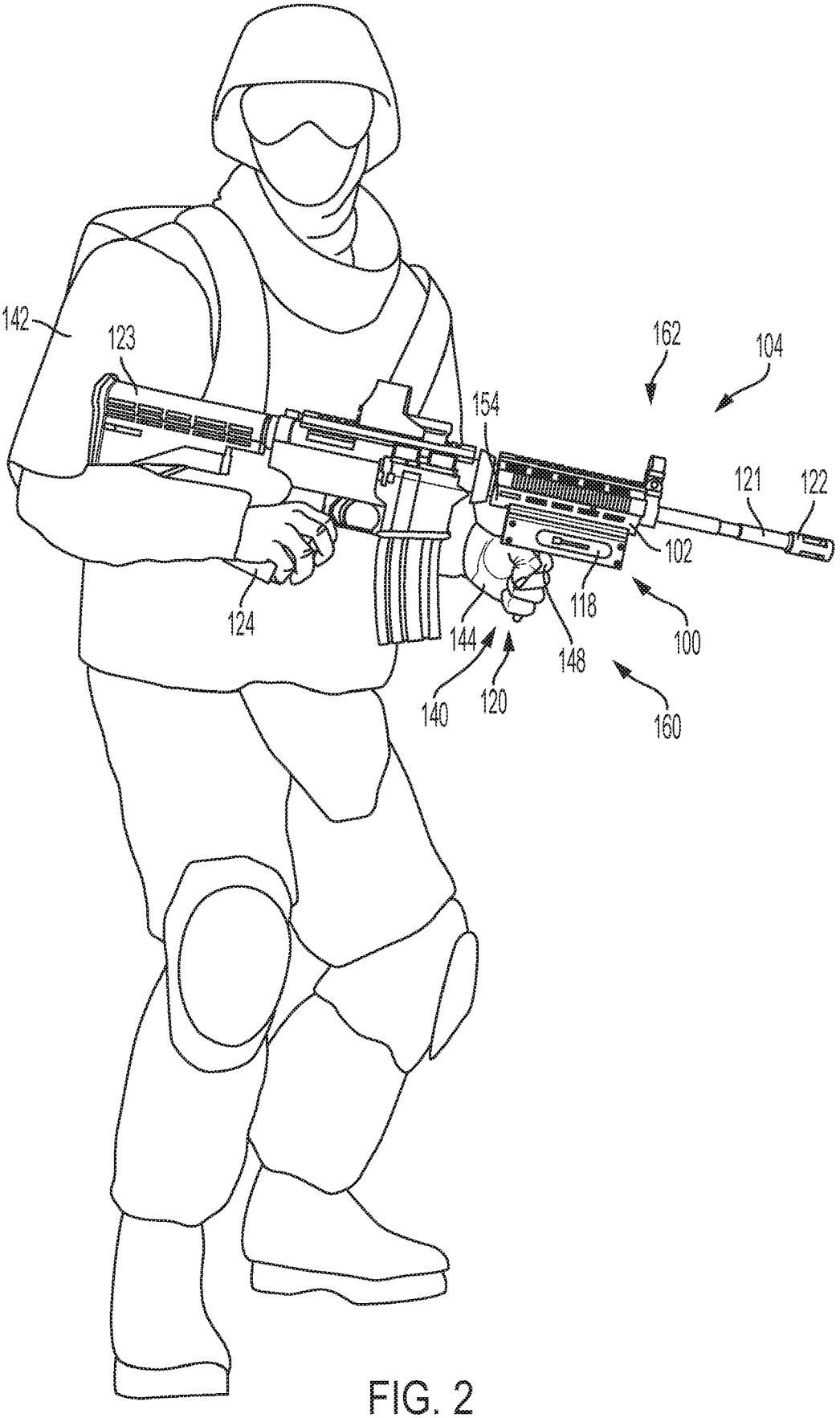
FIG. 2 is a side elevation view of the knife mount shown in FIG. 1 with a user holding the firearm by a pistol grip with a first hand and by a handle of the knife with a second hand.
Figure 3:
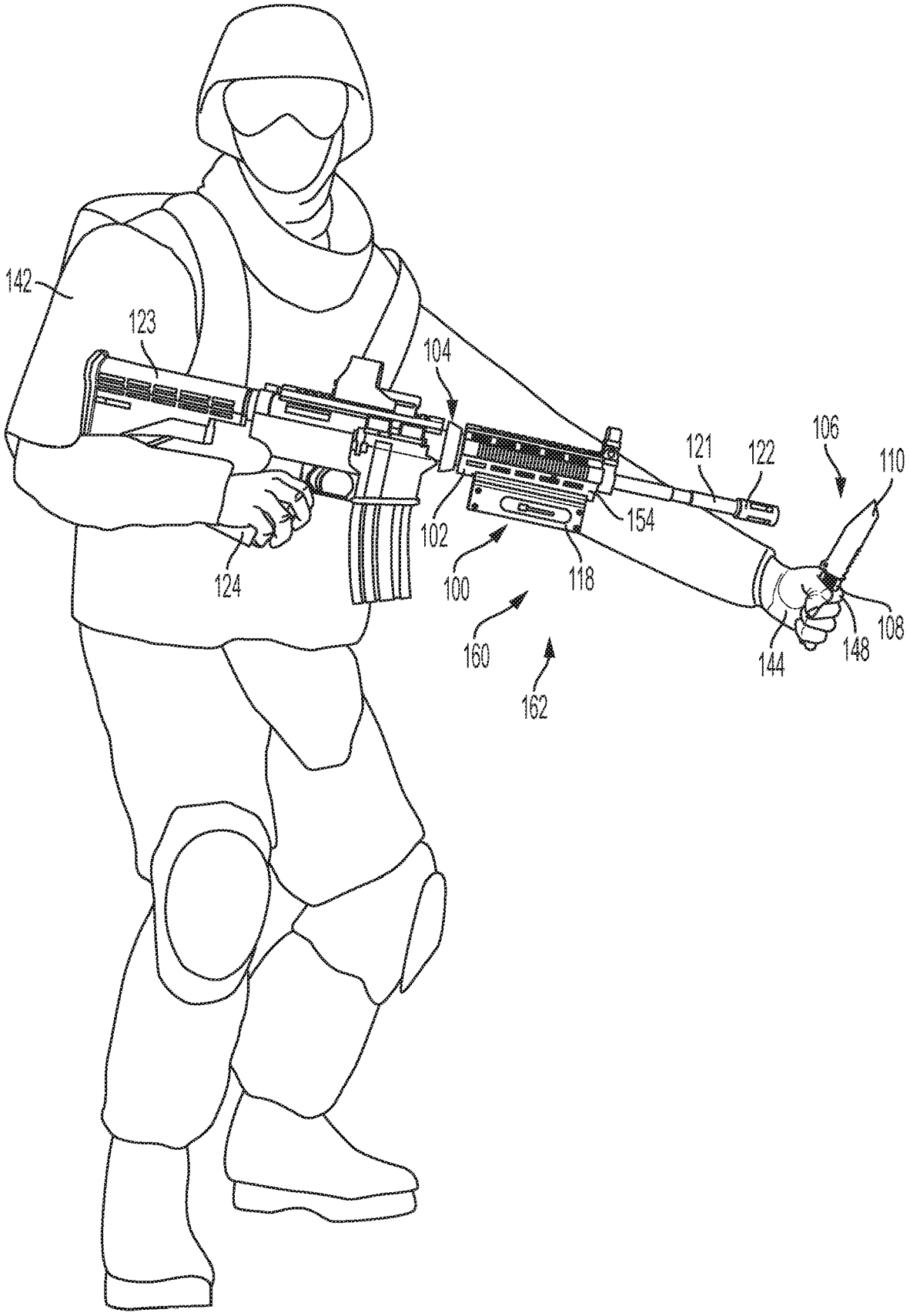
FIG. 3 is a side elevation view of the knife mount shown in FIG. 2 with a user holding the firearm by a pistol grip with the first hand and holding the handle of the knife selectively removed from the knife mount with a second hand with a knife blade automatically in a deployed position.

Further improving over conventional bayonet knife mounting configurations, the manner in which knife mount 100 mounts knife 106 to firearm 104 allows knife 106 to serve as a foregrip 140 to enhance the user's ability to aim and manipulate firearm 104. Of particular benefit for safety and convenience, as shown in FIGS. 2 and 3, knife mount 100 allows the user to quickly and easily release knife 106 from knife mount 100 to use separate from firearm 104. Indeed, knife mount 100 allows the user to rapidly release knife 106 with a single hand.

To assist with understanding the knife mounts described herein, the features of firearm 104 and knife 106 will be briefly discussed. The reader should understand that firearm 104 and knife 106 are just particular examples of a firearm and a knife suitable to use with the presently disclosed knife mounts. The knife mounts described here may be used with a wide variety of firearm and knife designs.

Firearm

Figure 1:
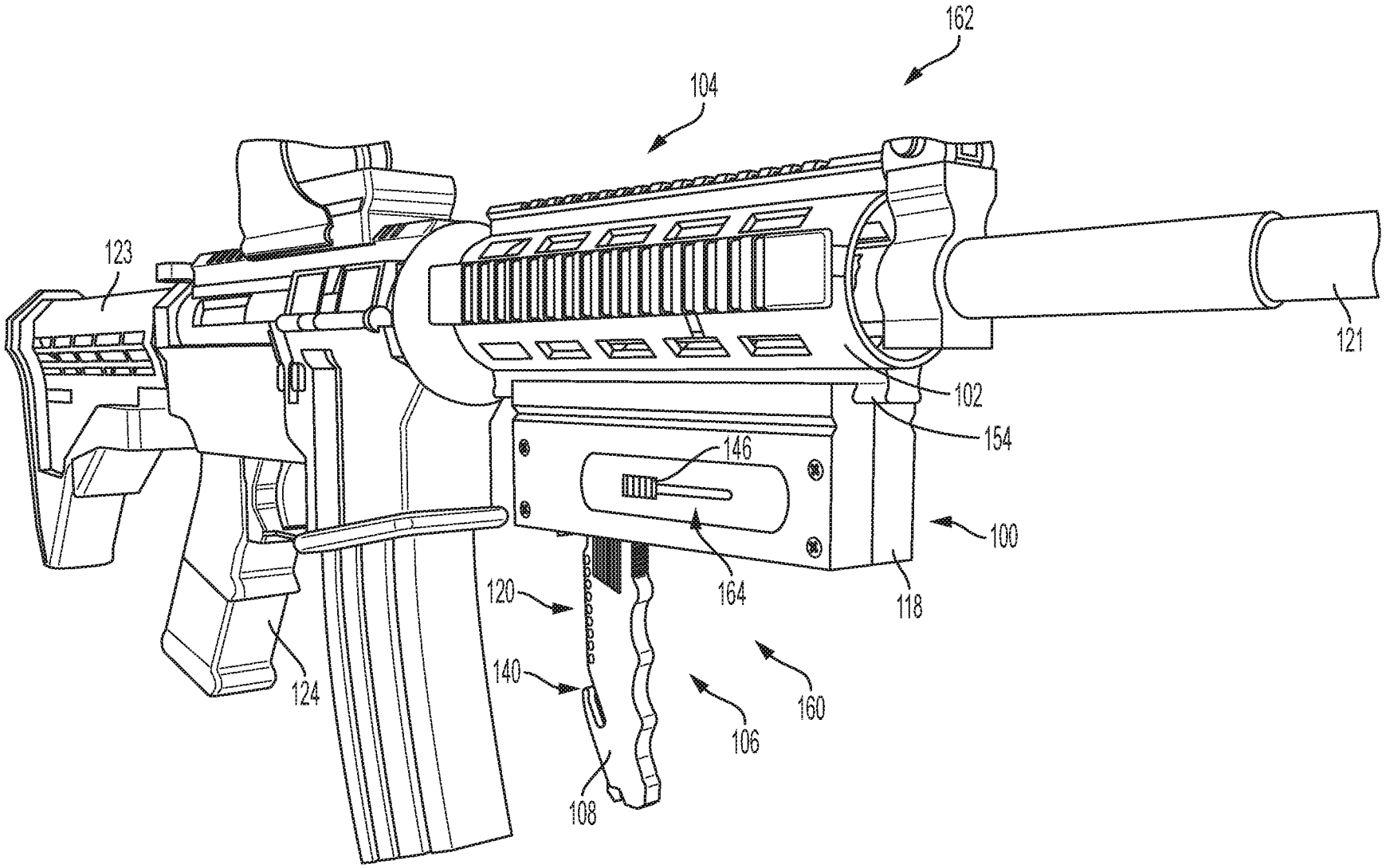
FIG. 1 is a perspective view of a first example of a knife mount secured to a firearm with a knife mounted to the knife mount.

As shown in FIGS. 1-3, firearm 104 is an assault rifle. Other suitable firearms include hunting rifles, sniper rifles, shotguns, pistols, handguns, and the like. The firearm may be configured for automatic, semi-automatic, and single fire operation.

With reference to FIGS. 1-3, firearm 104 includes a stock 123, a pistol grip 124, a handguard 102, a rail 154, a barrel 121, and a muzzle 122. Rail 154 is attached to handguard 102 on an underside of handguard 102 between muzzle 122 and pistol grip 124. A foregrip position 120 is defined on the underside of handguard 102 between muzzle 122 and pistol grip 124.

Rail 154 is a conventional Picatinny rail designed to mount a variety of accessories to a firearm. Other suitable rails include Weaver rails, Dovetail rails, NATO Accessory rails. Keymod rails, and M-LOK rails. The inventor contemplates the knife mounts described herein being adapted to interface with any currently known or later developed rail interface system for mounting accessories to firearms.

Knife

Shifting focus to the details of knife 106, the reader can see in FIGS. 1 and 3-9 that knife 106 includes a handle 108 and blade 110. Blade 110 is moveably mounted to handle 108 and is configured to move between a stowed position 112 and a deployed position 116. In stowed position 112, shown in solid lines in FIG. 9, a tip 114 of blade 110 is proximate handle 108. In deployed position 116, shown in dotted lines in FIG. 9, tip 114 of blade 110 is distal handle 108. Blade 110 can also be moved to and remain at an intermediate position 155 between stowed position 112 and deployed position 116.

In the particular example shown in the figures, knife 106 is a manually folding knife configured for blade 110 to pivot relative to handle 108 between stowed position 112 and deployed position 116. In this context, manually folding means that blade 110 is configured to fold without mechanical assistance in contrast to a spring-assisted knife or switchblade. In particular, knife 106 does not include mechanical means to automatically pivot blade 110 between stowed position 112 and deployed position 116 with mechanical assistance; yet blade 110 still readily deploys when a user removes knife 106 from knife mount 100. While knife 106 is configured to fold manually, knife mounts described herein can readily accommodate spring-assisted opening knives. In certain configurations, the knife mount accommodates a fixed blade knife.

The particular size, shape, and configuration of handle 108 and blade 110 shown in the figures is not essential for use with knife mounts discussed in this disclosure. Indeed, the handle may take many different forms to suit different uses and preferences, such as providing various finger grips, ribbing profiles, and hilt styles. Likewise, the blade may assume different forms, such as including serrations, holes, and different profiles. The knife mounts discussed herein may be complimentarily configured with most any knife design.

Knife Mount

Turning attention to FIGS. 1-10, knife mount 100 will now be described in more detail. As can be seen in the figures, knife mount 100 configured to secure to handguard 102 of firearm 104. Knife mount 100 is further configured to releasably secure a knife 106. In operation, knife mount 100 serves to selectively fix knife 104 to handguard 102 at foregrip position 120 to allow knife 104 to serve as a foregrip 140.

The figures show that knife mount 100 includes, a body 118, a slot 126, a locking mechanism 132, a selection mechanism 164, and a light 150. In other examples, the knife mount includes additional or alternative features, such as a laser sight, a camera (still or video), a global positioning system, and/or a communications device. As shown in FIGS. 1 and 2, knife mount 100 coupled with knife 106 defines a releasable knife mechanism 160. As further shown in FIGS. 1-3, knife mount 100 coupled with knife 106 and firearm 104 defines a dual weapon system 162.

Body

As can be seen in FIGS. 1-3, body 118 is configured to secure to handguard 102. In the particular example shown in the figures, body secures to handguard 102 in foregrip position 120 disposed on an underside of handguard 102 between muzzle 122 and pistol grip 124. Body 118 is configured to secure to rail 154 and includes an interface 153 (shown in FIG. 6) complimenting a corresponding interface of rail 154. In the present example, rail 154 is a Picatinny rail and interface 153 of body 118 is configured to mount to a Picatinny rail.

Body 118 is comprised of metal, but may be formed from any suitable currently known or later developed material, such as plastic or other polymers. In some examples, the body is comprised of two lateral components secured together. In other examples, the body is a unitary component. In still further examples, the body is formed from multiple components secured together.

Slot

In the example shown in FIGS. 4, 5, 7, 9, and 10, slot 126 is defined in body 118 and is complimentarily configured with knife 106 to receive knife 106. As shown in FIGS. 4, 5, 7, and 9, slot 126 defines a blade receiving portion 128 and a handle receiving portion 130 adjacent blade 110 receiving portion. Blade receiving portion 128 and handle receiving portion 130 cooperate to position blade 110 relative to handle 108 in an intermediate position 155 between stowed position 112 and deployed position 116 when knife 106 is inserted into slot 126.

Locking Mechanism

Figure 4:
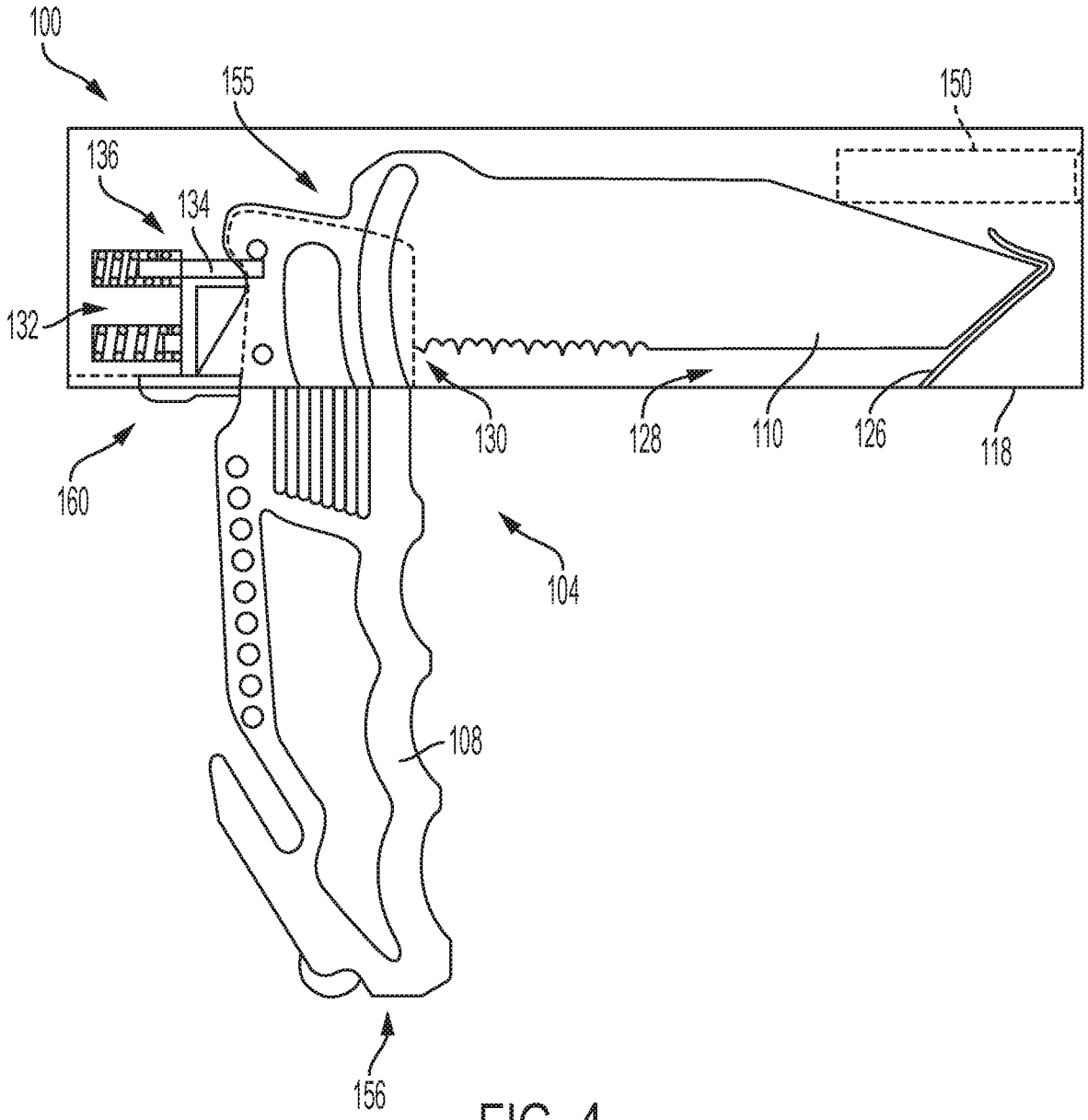
FIG. 4 is a side elevation view of the knife mount shown in FIG. 1 depicting internal structure of the knife mount supporting the knife when a locking mechanism of the knife mount is in a lock position securing the knife within the knife mount.
Figure 5:
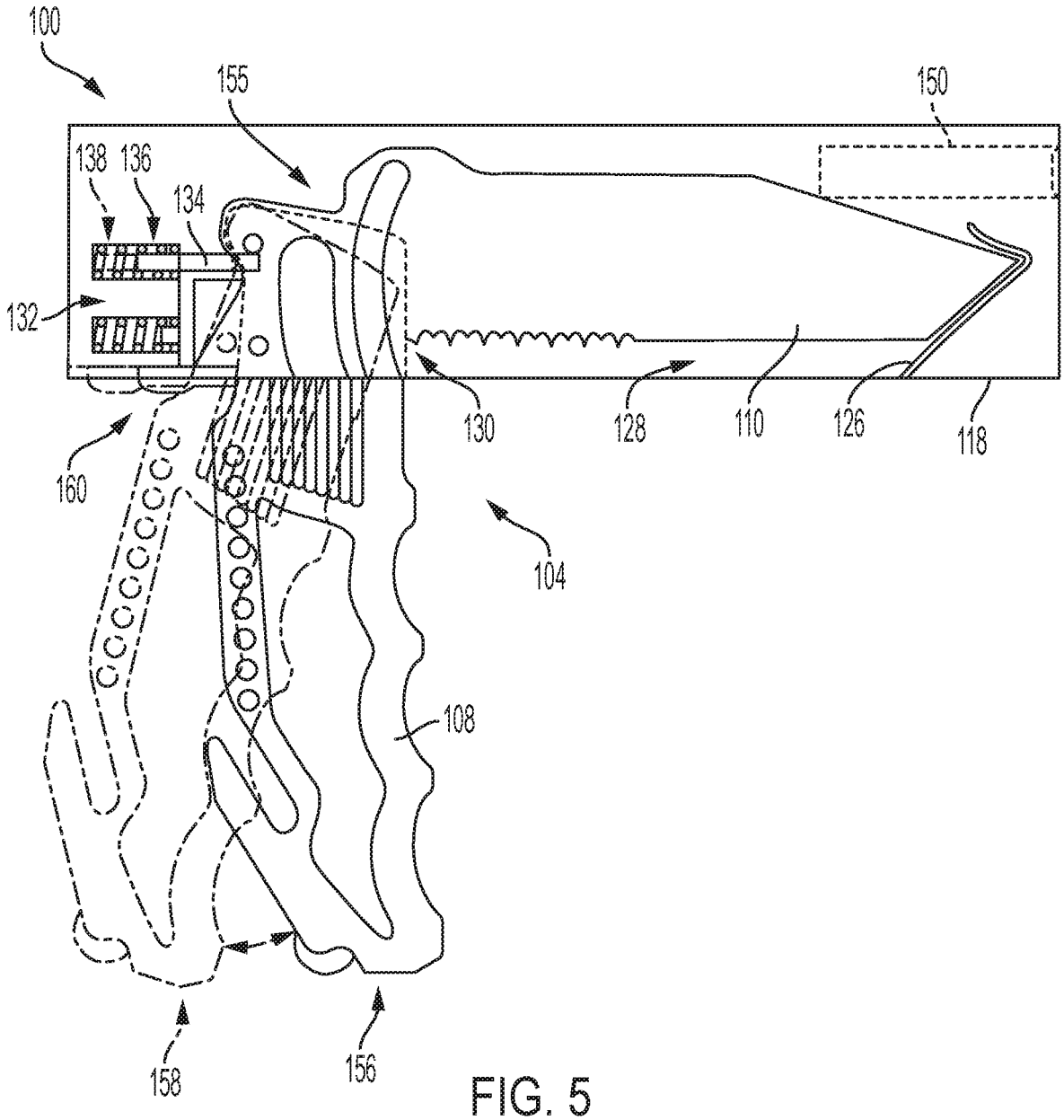
FIG. 5 is a side elevation view of the knife mount shown in FIG. 1 depicting a handle of the knife moving between a first transverse position where a locking mechanism of the knife mount is in lock position securing the knife within the knife mount and a second transverse position where the handle moves the locking mechanism into release position allowing the knife to be removed from the knife mount.

With reference to FIGS. 4 and 5, the reader can see that locking mechanism 132 is moveably mounted to body 118 proximate handle receiving portion of slot 126. As shown in FIGS. 4 and 5, locking mechanism 132 includes a catch 134 and is configured to selectively secure knife 106 within slot 126.

In the present example, locking mechanism secures knife 106 in slot by engaging catch 134 with handle 108 of knife 106. More particularly, locking mechanism 132 is configured to move between a lock position 136 where catch 134 engages handle 108 to secure knife 106 within slot 126 and a release position 138 where catch 134 disengages from handle 108 to allow handle 108 to move relative to slot 126. In the present example, catch 134 translates between lock position 136 and release position 138.

In this manner, blade 110 receiving portion, handle receiving portion 130, and locking mechanism 132 cooperate to rigidly secure knife 106 to body 118. In operation, blade 110 is inserted into blade 110 receiving portion and handle 108 is partially inserted into handle receiving portion 130. Locking mechanism 132 is biased towards lock position 136 and moves to lock position 136 after knife 106 is fully inserted into slot 126.

Advantageously, blade 110 receiving portion, handle receiving portion 130, and locking mechanism 132 cooperate to rigidly secure knife 106 to body 118 in foregrip position 120. More specifically, these components cooperate to rigidly secure knife 106 to body 118 in foregrip position 120 in an orientation transverse to handguard 102 where handle 108 of knife 106 defines a foregrip 140 of firearm 104. In this manner, user 142 may grip foregrip 140 and manipulate firearm 104.

Handle 108 is held in position as foregrip 140 when locking mechanism 132 is in lock position 136. In the present example, locking mechanism 132 is biased to lock position 136. In other examples, the locking mechanism is biased to release position or not biased to either position.

When locking mechanism 132 is in release position 138, user 142 may rapidly remove knife 106 from body 118. In particular, slot 126 and locking mechanism 132 cooperate to enable a user 142 to selectively remove knife 106 from slot 126 by manipulating handle 108 of knife 106 with a single hand 144. Handle receiving portion is configured to accommodate handle 108 being selectively moved between a first transverse position 156 where locking mechanism 132 is in lock position 136 and a second transverse position 158 where handle 108 moves locking mechanism 132 into release position 138. Selectively pressing handle 108 of knife 106 against locking mechanism 132 when knife 106 is inserted into slot 126 moves locking mechanism 132 from lock position 136 to release position 138 to enable knife 106 to be removed from slot 126.

User 142 may readily press handle 108 against locking mechanism 132 to quickly release knife 106 by gripping handle 108 with single hand 144 and pulling handle 108 towards pistol grip 124. Providing great utility and convenience, user 142 is already holding knife 106 by handle 108 in a position to use knife 106 when knife 106 is removed from knife mount 100. In this manner, user 142 can go from holding firearm 104 by foregrip 140 to wielding knife 106 in deployed position 116 very quickly.

Figure 7:
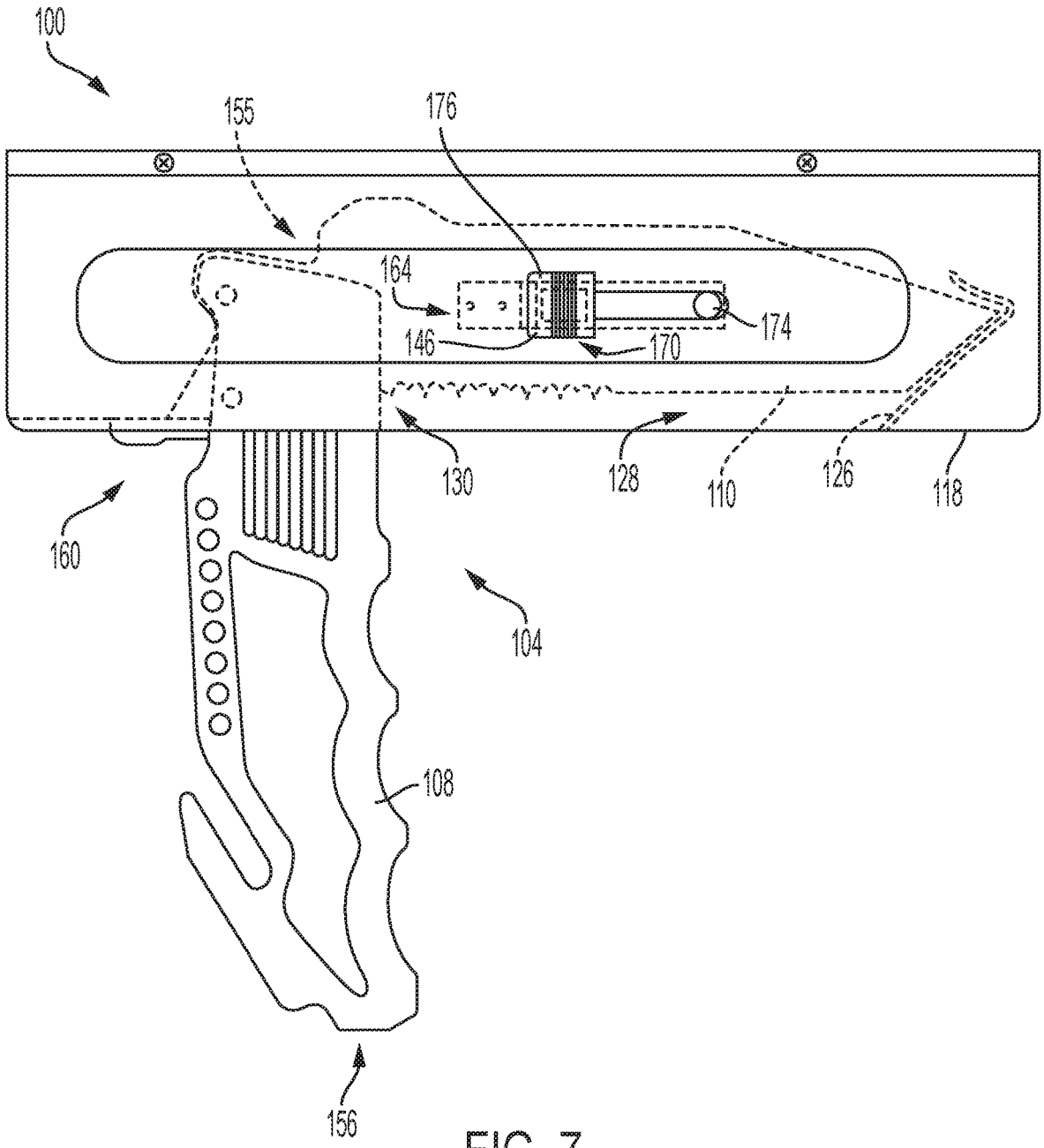
FIG. 7 is a side view of the knife mount shown in FIG. 1 depicting a selection mechanism for selectively securing the knife within the slot.
Figure 10:
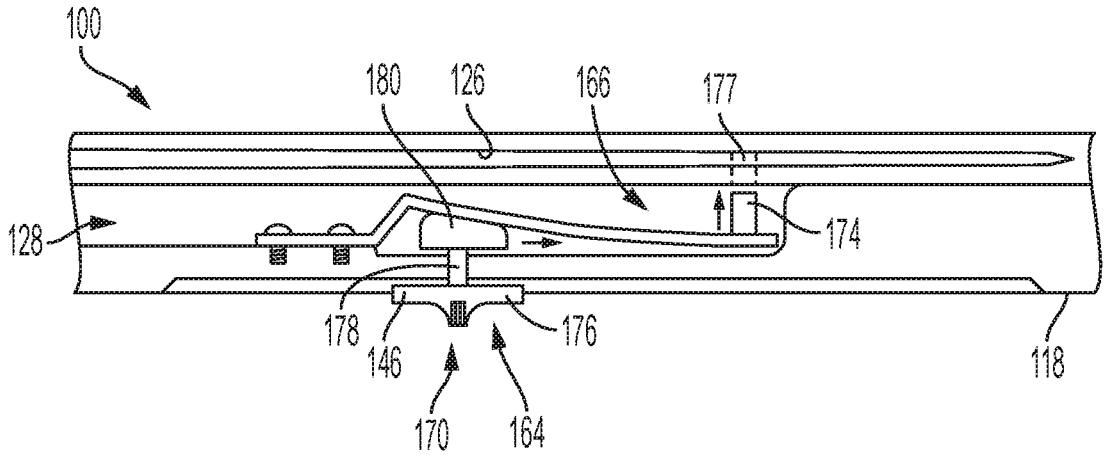
FIG. 10 is a top view of the knife mount shown in FIG. 1 depicting internal structure, including a selection mechanism with a cantilever spring in a spaced position where the selection mechanism allows the knife to be removed from the slot and depicting arrows indicating the selection mechanism moving to secure the knife within the slot.

In the example shown in FIGS. 7 and 10, knife mount 100 includes a selection mechanism 164 configured to selectively restrict blade 110 from moving within slot 126. In this manner, selection mechanism 164 operates to selectively secure knife 106 to firearm 104 via knife mount 100.

More fully securing blade 110 within slot 126 reduces the risk of unintentionally removing knife 106 from knife mount 100 when user 142 manipulates firearm 104 using handle 108 serving as foregrip 140. A user may select to more fully secure blade 110 within slot 126 with selection mechanism 164 when knife 106 is not needed for use as a knife, when carrying firearm 104 through brush or other environments that could snag handle 108, when storing firearm 104, or when shipping firearm 104. Additionally or alternatively, user 142 may elect to more fully secure blade 110 within slot 126 simply to increase confidence that knife 106 will serve exclusively as foregrip 140 for peace of mind when using firearm 104.

As shown in FIGS. 7 and 10, selection mechanism 164 includes a switch 146, a cantilever spring 164 and a restriction member 174. Briefly, switch 146 is manipulated by user 142 to selectively move selection mechanism 146 between positions where it restricts blade 110 within slot 126 (arrest position shown by the arrow in FIG. 10) and where selection mechanism 146 allows blade 110 to move relative to slot 126 (spaced position 166 shown in FIG. 10). Restriction member 174 is configured to engage with blade 110 of knife 106 in slot 126 to restrict blade 110 from moving within slot 126.

The reader can see from FIGS. 1-3, 7, and 10 that selection mechanism 164 is mounted to body 118 in a position to be easily engaged by user 142. In particular, switch 146 is mounted partially on an outside of body 118 in a position to be engaged by one or more of user's fingers.

Switch 146 is configured to slide between a first position 170 and a second position (as indicated by arrow in FIG. 10)

to selectively restrict blade 110 from moving within slot 126. In the present example, switch 146 includes an external portion 176, a bridge portion 178, and an internal portion 180.

External portion 176 of switch 146 is disposed outside of body 118 and configured to be engaged by one or more of user's fingers. Bridge portion 178 couples external portion 176 to internal portion 180. Internal portion 180 is disposed inside body 118 and engages cantilever spring 164. As can be seen in FIG. 10, internal portion 180 is wedge shaped, but a wide variety of other shapes and configurations are suitable.

In the present example, cantilever spring 164 bias selection mechanism 164 to a position where selection mechanism 164 allows blade 110 to move relative to slot 126. In other examples, the cantilever spring bias the selection mechanism to a position that restricts the blade from moving within the slot. In still further examples, the selection mechanism does not include a spring and does not bias the selection mechanism to one position or another. Instead, the selection mechanism includes a relatively non-elastic linking member to couple the switch to the projection.

Restriction member 174 is mounted to an end of cantilever spring 164 and faces blade 110 disposed in slot 126. Restriction member 174 is configured to engage with blade 110 of knife 106 in slot 126 when cantilever spring 164 is in the arrest position indicated by the arrow in FIG. 10 to secure blade 110 within slot 126. In the present example, restriction member 174 is a projection complimentarily configured and aligned with a hole in blade 110. Restriction member 174 inserts within the hole when cantilever spring 164 is in the arrest position. In other examples, the restriction member is a clamp or brake member that presses against the blade to restrict the blade from moving within the slot.

With continued reference to FIG. 10, cantilever spring 164 is positioned to be engaged by switch 146. In the present example, cantilever spring 164 is engaged by internal portion 180 of switch 146. As switch 146 moves from first position 170 to the second position, internal portion 180 pushes cantilever spring 164 from spaced position 166 towards blade 110 mounted in slot 126, which is the arrest position of cantilever spring 164 indicated by the arrow in FIG. 10.

Figure 6:
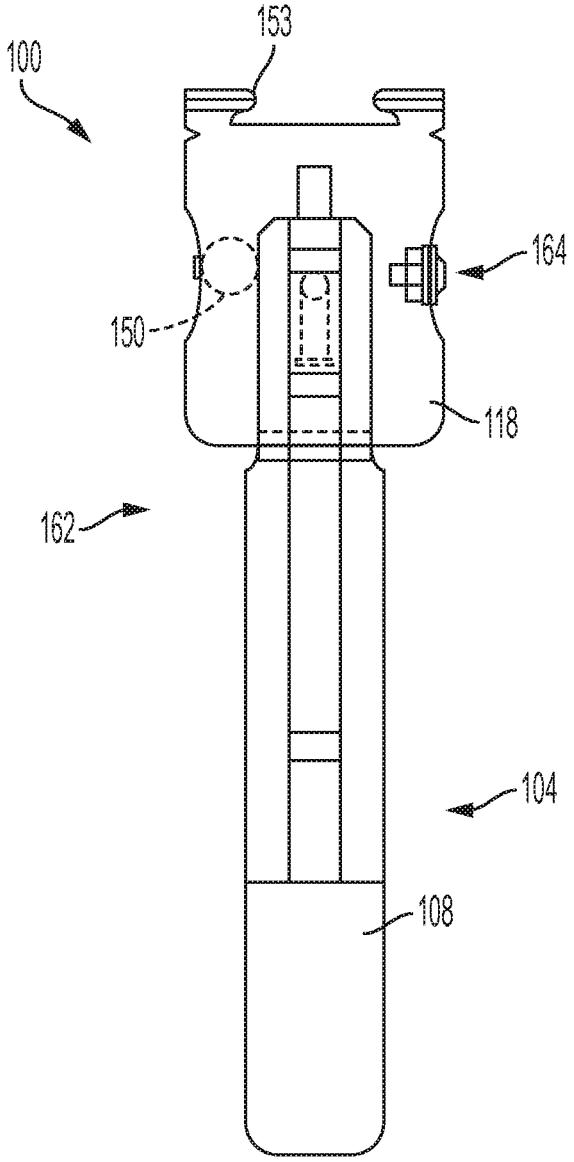
FIG. 6 is a rear view of the knife mount shown in FIG. 1 depicting a rail mount for selectively mounting the knife mount to a firearm.
Figure 8:
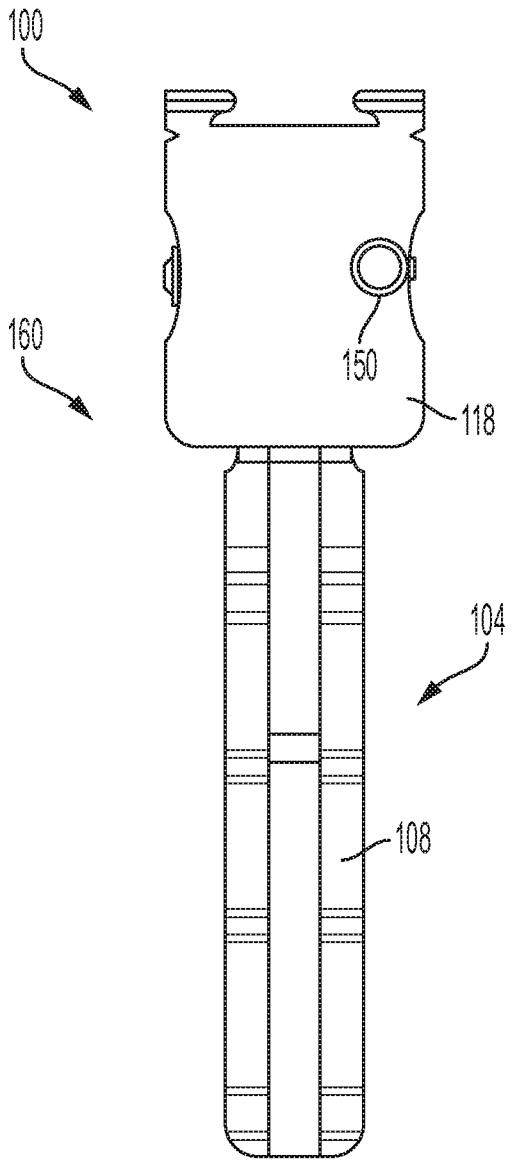
FIG. 8 is a front view of the knife mount shown in FIG. 1 depicting a light mounted to the knife mount for illuminating an area in front of the firearm.
Figure 9:
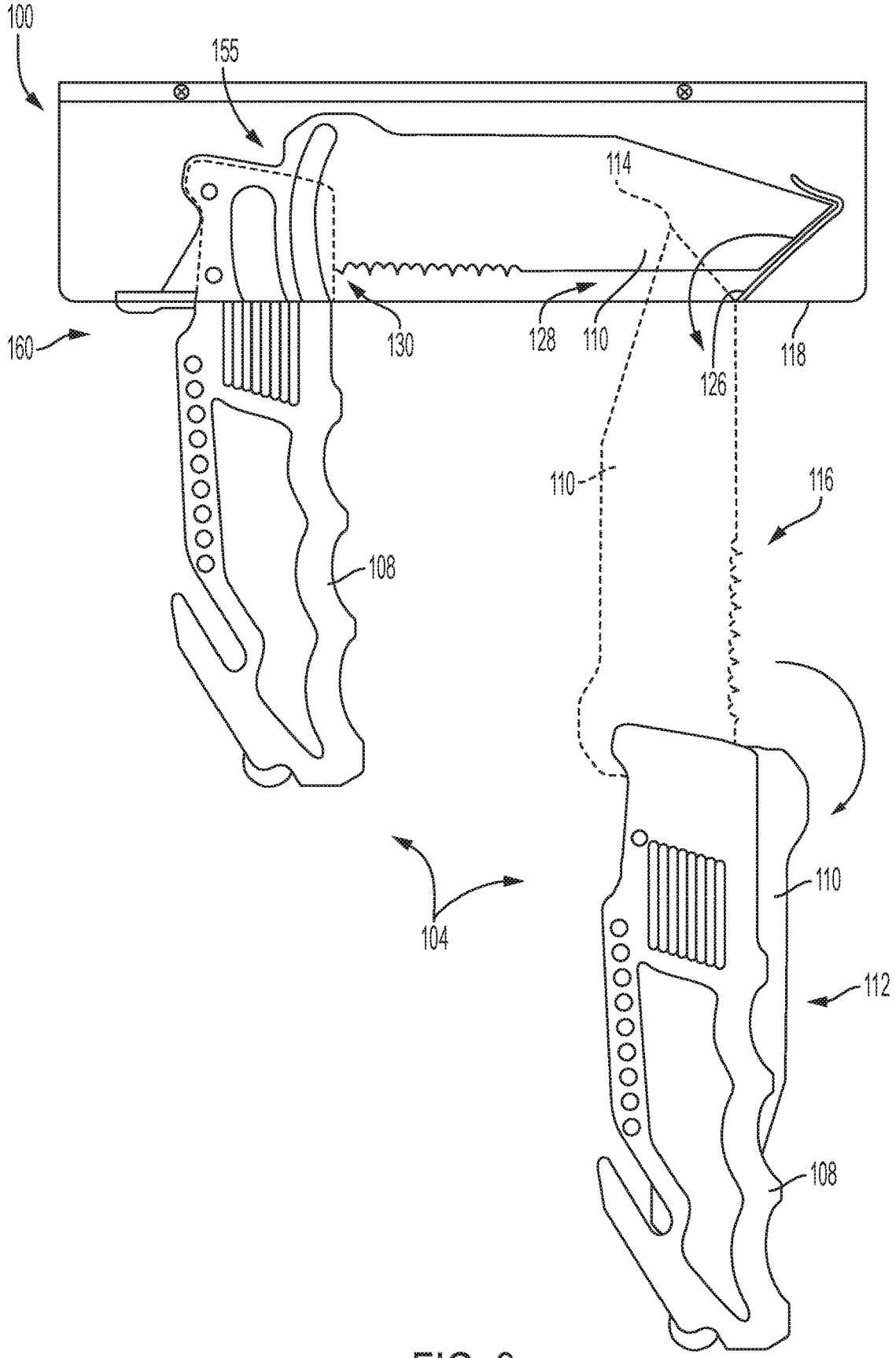
FIG. 9 is a side view of the knife shown in FIG. 1 depicting a blade of the knife pivoting relative to the handle between a stowed position and a deployed position and depicting the knife mounted in the knife mount.

As shown in FIGS. 5, 6, and 8, knife mount 100 includes a light 150 mounted to body 118 to provide illumination. Light 150 is configured to provide illumination in front of firearm 104, but the light could be mounted in other positions. In some examples the knife mount includes multiple lights disposed at different positions on the body to provide illumination to the sides, bottom, and front of the firearm. In other examples, the knife mount does not include a light. Any currently known or later developed light suitable in size, shape, and function for use with the knife mount, such as light emitting diodes, may be selected. The reader should understand that any currently known and later developed auxiliary components for the light to operate, such as batteries and circuitry, may be selected.

In some examples, the knife mount includes a laser sight or laser pointer to help aim the firearm in addition to or instead of the light. Any currently known or later developed laser sight or other illuminated targeting system suitable in size, shape, and function for use with the knife mount may be used.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A knife mount configured to selectively secure to a handguard of a firearm and configured to releasably secure a knife, the knife having a handle and a blade moveably mounted to the handle wherein the blade is configured to move between a stowed position where a tip of the blade is proximate the handle and a deployed position where the tip of the blade is distal the handle, the knife mount comprising:

a body configured to secure to the handguard in a foregrip position disposed on an underside of the handguard between a muzzle of the firearm and a pistol grip of the firearm;

a slot defined in the body and the slot complimentarily configured to receive the knife, the slot defining a blade receiving portion and a handle receiving portion adjacent the blade receiving portion; and a locking mechanism moveably mounted to the body proximate the handle receiving portion of the slot, the locking mechanism including a catch and the locking mechanism configured to selectively secure the knife within the slot by engaging the catch with the handle of the knife, the locking mechanism being configured to move between a lock position where the catch engages the handle of the knife to secure the knife within the slot and a release position where the catch disengages from the handle of the knife to allow the handle to move relative to the slot;

wherein the blade receiving portion, the handle receiving portion, and the locking mechanism cooperate to rigidly secure the knife to the body in the foregrip position in an orientation where the handle of the knife defines a foregrip of the firearm for a user to grip and manipulate the firearm when the locking mechanism is in the lock position and to allow the user to rapidly remove the knife from the body when the locking mechanism is in the release position; and wherein the blade is longitudinally aligned with the handguard in the blade receiving portion.

2. The knife mount of claim 1, wherein the slot and the locking mechanism cooperate to enable a user to selectively remove the knife from the slot by manipulating the handle of the knife with a single hand.

3. The knife mount of claim 1, wherein the locking mechanism is biased to the lock position.

4. The knife mount of claim 1, wherein the catch translates between the lock position and the release position.

5. The knife mount of claim 1, wherein the blade of the knife is configured to pivot relative to the handle between the stowed position and the deployed position.

6. The knife mount of claim 5, wherein the knife does not include mechanical means to automatically pivot the blade of the knife between the stowed position and the deployed position with mechanical assistance.

7. The knife mount of claim 1, wherein the blade receiving portion, the handle receiving portion, and the locking mechanism cooperate to rigidly secure the knife to the body in the foregrip position when the blade is inserted into the blade receiving portion, the handle is partially inserted into the handle receiving portion.

8. The knife mount of claim 7, wherein the locking mechanism is biased to the lock position and the locking mechanism automatically moves to the lock position after the knife is fully inserted into the slot.

9. The knife mount of claim 1, wherein selectively pressing the handle of the knife against the locking mechanism when the knife is inserted into the slot moves the locking mechanism from the lock position to the release position to enable the knife to be removed from the slot.

10. The knife mount of claim 1, further comprising a selection mechanism mounted to the body and configured to selectively restrict the blade from moving within the slot.

11. The knife mount of claim 10, where the selection mechanism includes a switch mounted partially on an outside of the body and configured to translate between a first position and a second position to selectively restrict the blade from moving within the slot.

12. The knife mount of claim 11, wherein the selection mechanism includes:

a cantilever spring positioned to engage the switch, where the cantilever spring moves between a spaced position and an arrest position as the switch moves between the first position and the second position, respectively, the cantilever spring being biased towards the spaced position; and a restriction member mounted to an end of the cantilever spring, the restriction member being configured to engage the blade of the knife in the slot when the cantilever spring is in the arrest position to secure the blade within the slot.

13. The knife mount of claim 1, further comprising a light mounted to the body to provide illumination.

14. The knife mount of claim 1, wherein the handguard includes a rail and the body is mounted to the rail.

15. The knife mount of claim 1, wherein the blade receiving portion and the handle receiving portion cooperate to position the blade relative to the handle in an intermediate position between the stowed position and the deployed position when the knife is inserted into the slot.

16. The knife mount of claim 15, wherein the handle receiving portion and the locking mechanism cooperate to position the handle transverse to the handguard for the the handle of the knife to define the foregrip of the firearm.

17. The knife mount of claim 16, where the handle receiving portion is configured to accommodate the handle being selectively moved between a first transverse position where the locking mechanism is in the lock position and a second transverse position where the handle moves the locking mechanism into the release position.

18. The knife mount of claim 1, further comprising the knife to define a releasable knife mechanism.

19. The knife mount of claim 1, further comprising the knife and the firearm to define a dual weapon system.

20. A knife mount configured to selectively secure to a handguard of a firearm and configured to releasably secure a knife, the knife having a handle and a blade pivotally mounted to the handle wherein the blade is configured to pivot between a stowed position where a tip of the blade is proximate the handle and a deployed position where the tip of the blade is distal the handle, the knife mount comprising:

a body configured to secure to the handguard in a foregrip position disposed on an underside of the handguard between a muzzle of the firearm and a pistol grip of the firearm;

a slot defined in the body and the slot complimentary configured to receive the knife, the slot defining a blade receiving portion and a handle receiving portion adjacent the blade receiving portion; and a locking mechanism moveably mounted to the body proximate the handle receiving portion of the slot, the locking mechanism including a catch and the locking mechanism configured to selectively secure the knife within the slot by engaging the catch with the handle of the knife within the slot, the locking mechanism being configured to move between a lock position where the catch engages the handle of the knife to secure the knife within the slot and a release position where the catch disengages from the handle of the knife to allow the handle to move relative to the slot;

wherein the blade receiving portion, the handle receiving portion, and the locking mechanism cooperate to rigidly secure the knife to the body in the foregrip position in an orientation where the handle of the knife extends transverse to the handguard to define a foregrip of the Firearm for a user to grip and manipulate the firearm when the locking mechanism is in the lock position and to allow the user to rapidly remove the knife from the body when the locking mechanism is moved to the release position by pressing the handle of the knife disposed in the handle receiving portion against the locking mechanism; and wherein the blade is longitudinally aligned with the handguard in the blade receiving portion.

* * * * *